US012214943B2

(12) United States Patent
Hodrius et al.

(10) Patent No.: US 12,214,943 B2
(45) Date of Patent: Feb. 4, 2025

(54) PACKAGING HANG TAB ASSEMBLY

(71) Applicant: Apple Inc., Cupertino, CA (US)

(72) Inventors: Manuel Hodrius, Potsdam (DE); Jonathan M. McCarren, San Jose, CA (US)

(73) Assignee: Apple Inc., Cupertino, CA (US)

( * ) Notice: Subject to any disclaimer, the term of this patent is extended or adjusted under 35 U.S.C. 154(b) by 333 days.

(21) Appl. No.: 17/895,790

(22) Filed: Aug. 25, 2022

(65) Prior Publication Data

US 2024/0067421 A1 Feb. 29, 2024

(51) Int. Cl.
*B65D 51/24* (2006.01)
*B65D 25/22* (2006.01)

(52) U.S. Cl.
CPC ..... *B65D 51/248* (2013.01); *B65D 25/22* (2013.01); *B65D 51/242* (2013.01); *B65D 2401/05* (2020.05)

(58) Field of Classification Search
CPC .... B65D 51/248; B65D 25/22; B65D 51/242; B65D 2401/05; B65D 2401/00; B65D 5/4208; B65D 73/0071; B65D 73/0078; G09F 3/0341
USPC ..... 229/117.14, 117.23; 206/163, 348, 806; 220/751; 248/317, 205.3; 294/27.1
See application file for complete search history.

(56) References Cited

U.S. PATENT DOCUMENTS

| | | | | |
|---|---|---|---|---|
| 5,683,029 | A | 11/1997 | Lyons | |
| 6,375,239 | B1 * | 4/2002 | Reed | B65D 5/4212 229/117.23 |
| 6,769,541 | B1 * | 8/2004 | Carriere | A47F 5/0043 206/820 |
| 6,994,307 | B2 * | 2/2006 | Curtsinger | B23D 59/00 248/205.3 |
| 9,708,104 | B2 | 7/2017 | Lyzenga et al. | |
| 10,060,461 | B2 | 8/2018 | Korinek | |
| 10,358,264 | B1 * | 7/2019 | Bristol | B65D 21/0205 |
| 11,214,091 | B2 | 1/2022 | Pascua et al. | |
| 2009/0236351 | A1 * | 9/2009 | Chu | B65D 25/22 53/484 |
| 2013/0228491 | A1 * | 9/2013 | Glass | B65D 73/0007 206/525 |
| 2015/0028089 | A1 | 1/2015 | Dixon et al. | |
| 2017/0323191 | A1 | 11/2017 | Pascua et al. | |
| 2020/0353669 | A1 | 11/2020 | Huffer | |
| 2022/0088897 | A1 | 3/2022 | Huffer | |

* cited by examiner

*Primary Examiner* — Christopher R Demeree
(74) *Attorney, Agent, or Firm* — Sterne, Kessler, Goldstein & Fox P.L.L.C.

(57) ABSTRACT

A hang tab assembly includes a paper outer layer and inner layer. The outer layer may include a hanging panel, a tear-away panel adjacent to the hanging panel, a first kiss-cut path on an upper surface of the outer layer, and a second kiss-cut path on a lower surface of the tear-away panel, the second kiss-cut path offset from the first. The assembly may include a first adhesive disposed on the lower surface of the tear-away panel, and a second adhesive disposed on a lower surface of the inner layer facing away from the outer layer. The outer layer may include a tear-away portion that tears transversely between offset kiss-cut paths to unseal a sealed package and expose internal paper material to provide visual indication that the package has been unsealed.

20 Claims, 10 Drawing Sheets

PACKAGING HANG TAB ASSEMBLY

FIELD

The present disclosure relates to a hang tab device, and more specifically, to a paper hang tab device for affixation to a package to hang and display the package with a tamper-evident seal.

BACKGROUND

Retail stores and other establishments often include displays, racks, and other equipment for displaying items to customers. These items may be displayed for a variety of reasons, such as, for example, being offered for sale, presented for their aesthetic characteristics or to advertise various models, presented as memorabilia or collectibles, for other reasons, or for a combination of such reasons. In some cases, such displayed items are packages (e.g., boxes), or are contained within packages. It may be desired to hang a package for display, and to maintain the package in a closed configuration. It may also be desired to facilitate opening of the package by a user, and to present visible indication that the package has been opened or has remained in an unopened state.

Accordingly, various items to be sold and/or displayed at retail stores may be provided in packages with a hanging feature such as a hang tab for hanging and displaying the packages. The hang tabs may have an opening or slot through which, e.g., a wire rack or peg may be inserted to thereby hang the package, and can be adhered to the box or package thereby hanging from the wire rack. The hang tab may further provide a tamper-evident seal by sealing the package through, e.g., an adhesive, such that a customer may confirm that the package is in a new condition, and has not been previously opened, when the hang tab seal remains unbroken and undamaged. Such hang tabs may be made of plastic material such as PVC, PP, PS, PE or PET. Some may be made of transparent polyester resin that does not obscure the package the tab is adhered to.

Structural and environmental considerations may also play a role in designing a package and a hang tab used for the package. What is needed is a hanging device for a package that can hold and hang the package and maintain the integrity of the package prior to being received by an end user and that can indicate prior opening of the package, but be easily removable and increase recyclability of the packaging, while providing robustness, eco-friendly materials, secure closure mechanisms with intuitive user experiences, and aesthetic elements.

SUMMARY

Apparatuses and systems for hanging a package with technical benefits are provided. Some embodiments are directed to a hang-tab package-sealing system including a hang-tab sealing assembly and a package. The hang-tab sealing assembly includes a paper outer layer and a paper inner layer. The paper outer layer includes a hanging panel including a first opening, a tear-away panel adjacent to and integral with the hanging panel, a first kiss-cut path extending in a longitudinal direction along a boundary between the hanging panel and the tear-away panel on one surface of the outer layer, and a pair of second kiss-cut paths spaced apart from each other and extending on the tear-away panel in the longitudinal direction at another surface of the outer layer. The second kiss-cut paths are offset from the first kiss-cut path. The paper inner layer includes a second opening that corresponds to the first opening. The package is movable between an open and a closed configuration and includes a tuck flap and a side wall. The tuck flap and the side wall are parallel to each other when the package is in the closed configuration. The inner layer is affixed to the tuck flap and disposed between the tuck flap and the package side wall when the package is in the closed configuration. The package is sealed in the closed configuration by a first adhesive adhering a portion of the tear-away panel to an outer surface of the package side wall and a second adhesive adhering a portion of the inner layer to the tuck flap.

Some embodiments are directed to a hang tab assembly for sealing and hanging a package. The assembly includes a paper outer layer and a paper inner layer. The paper outer layer includes a hanging panel including a first opening, a tear-away panel adjacent to the hanging panel, a first kiss-cut path extending in a longitudinal direction along a boundary between the hanging panel and the tear-away panel on an upper surface of the outer layer, and a second kiss-cut path extending in the longitudinal direction on a lower surface of the tear-away panel. The second kiss-cut path is offset from the first kiss-cut path in a transverse direction orthogonal to the longitudinal direction. The paper inner layer includes a second opening corresponding to the first opening, and is coupled to the outer layer. The assembly may also include a first adhesive disposed on the lower surface of the tear-away panel entirely to one side of the second-kiss-cut path, and a second adhesive disposed on a lower surface of the inner layer facing away from the upper surface of the outer layer.

Some embodiments are directed to an apparatus for sealing a package. The apparatus includes a first panel formed of paper, a second panel formed of paper and extending from the first panel in a first direction in an integrated manner where the second panel includes at least one grip portion extending outward in a second direction perpendicular to the first direction, a primary kiss-cut path extending along a boundary between the first panel and the second panel at a first surface of the second panel and the first panel, and a pair of secondary kiss-cut paths extending on the second panel parallel to the primary kiss-cut path on a second surface of the second panel opposite the first surface, where the pair of secondary kiss-cut paths is offset from the primary kiss-cut path in the first direction.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
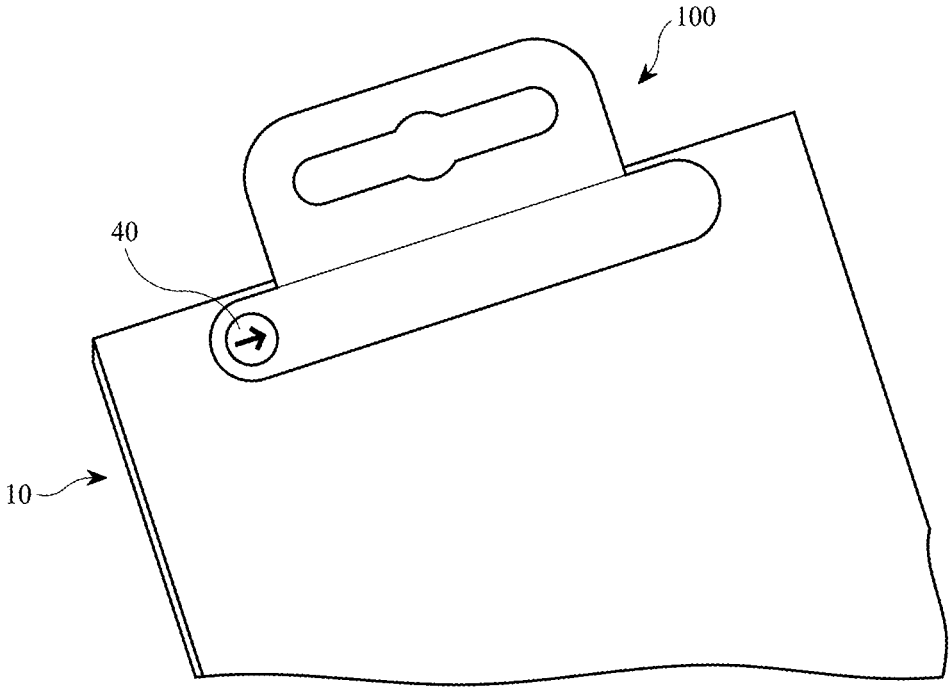
FIG. 1 illustrates a package having a hang tab assembly affixed thereto, according to some embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to hang tabs that may be used in packaging finished goods, where the hang tabs are made of paper adhered to the outside of the packaging or package, are easily opened by an end user, and serve to provide a tamper-evident seal while keeping the package closed. As described herein, packages with hang tabs provide secure finished goods packaging in a closed configuration and allow the packages to be hung for display. Moreover, such hang tabs allow an end user to recycle the entire package materials and further allow the package to be displayed aesthetically at a retail store.

Some embodiments include a package hang tab composed of one or more layers made of paper adhered to each other (other environmentally friendly recyclable or biodegradable materials are also envisioned). In some embodiments, each of the layers has a corresponding opening to be hung on a rack or peg. In an illustrated embodiment, one or more layers is formed with offset kiss-cuts on each side for allowing the respective layer to be torn laterally within the layer when a user pulls on a grip portion of the layer to separate a tear strip from the hang tab and thereby allow the package to be opened. Further, when the layer is thus laterally torn; tamper-evident interior surfaces of the paper layer are created and exposed because a lower portion of the layer remains adhered to the package while the upper portion is torn off. The layers composed of the package hang tab may be formed of the same material or different materials that are recyclable.

Once the hang tab is torn, partially or completely, by a user, resealing is not possible due to the characteristics of the unitary paper layer. This feature provides a packaging solution utilizing environmentally friendly materials while allowing for the hang tab functioning as a tamper-evident seal to provide added assurance to a customer or a retailer that the packaging has not been opened or tampered with (e.g., there has been no "unauthorized" opening of a package prior to the intended opening).

Hang tabs may be used for retail packages (i.e., finished packaging for containing and conveying a product to a user such as may be used in a retail setting, not shipping packaging providing outer packaging for containing a packaged product during shipment) that one may expect to find on the shelf in a retail store, and which one may open after purchase to directly access their product. The hang tabs may be made out of recyclable and/or biodegradable materials, such as paper, cardboard, greyboard, or other cellulose-based products that can reduce environmental impact. The packages to which the hang tabs are applied may be similarly formed of recyclable and/or biodegradable materials, such as paper, cardboard, greyboard, cardboard corrugate, or other cellulose-based products (e.g., the package may be formed of the same material as the hang tab). This can help reduce environmental impact, especially when it is intuitive for a customer to properly recycle the packaging with hang tab and it may be recycled in a single-stream system.

Packages used with such hang tabs as described herein may contain a product, for example, an electronic device such as, for example, headphones, or smartphone, or accessories for an electronic device. In any case, the hang tabs made of paper may be used in any retail store having various shaped wire racks or pegs for displaying products packaged in packages and secured sealed by the hang tabs.

These and other embodiments are discussed below with reference to FIGS. 1-10B. However, those skilled in the art will readily appreciate that the detailed description given herein with respect to these figures is for explanatory purposes only and should not be construed as limiting.

Figure 2:
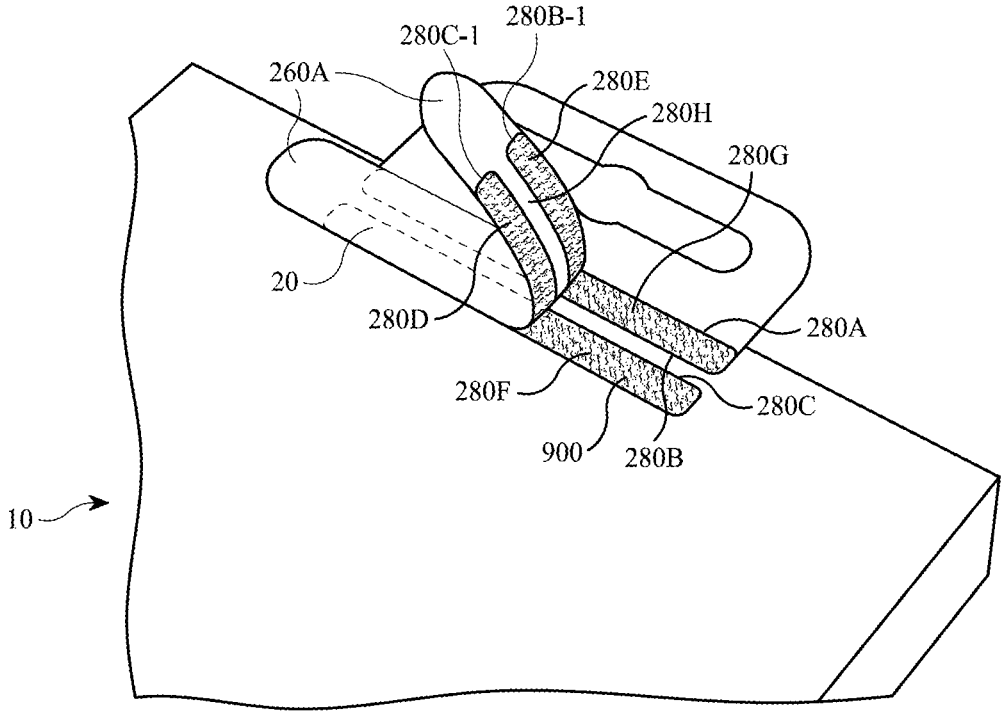
FIG. 2 illustrates the hang tab assembly affixed to a package for use, while the hang tab assembly is partially unsealed at kiss-cuts, according to some embodiments.
Figure 3:
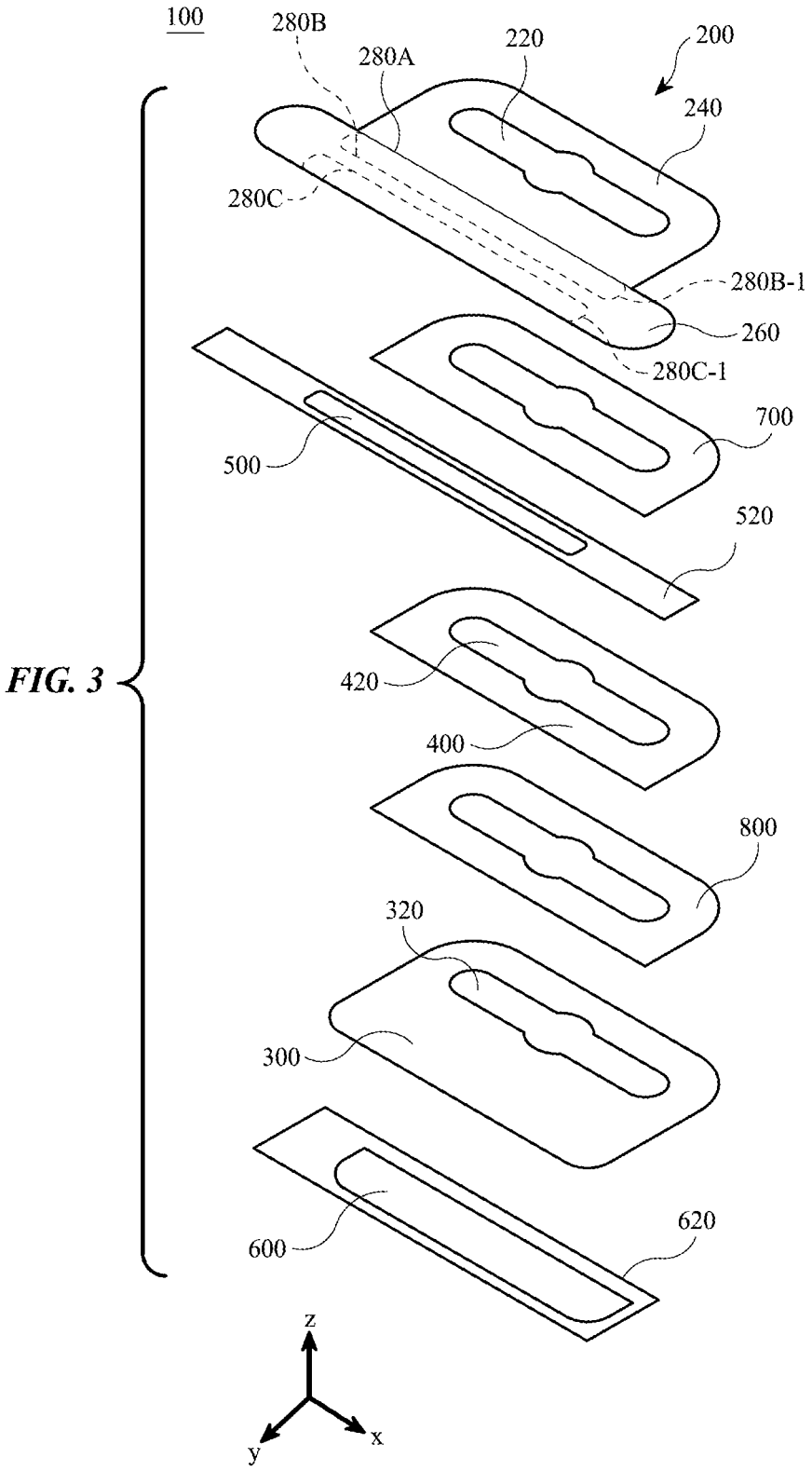
FIG. 3 illustrates an exploded view of the hang tab assembly according to some embodiments.

FIG. 1 illustrates a hang tab assembly 100 affixed to a package 10, according to some embodiments, and FIG. 2 illustrates hang tab assembly 100 affixed to package 10 in use, while the kiss-cut seal is partially unsealed. FIG. 3 illustrates exploded views of hang tab assembly 100, and FIGS. 4A, 4B, 5A, 5B, 6A and 6B illustrate hang tab assembly 100 in various states of assembly.

In some embodiments, hang tab assembly 100 can be used to display an item, such as a package 10 or an item contained therein. In some embodiments, package 10 may be a box. The displayed item, however, in some embodiments does not have to be a box or be contained within a package (e.g., a box), but can be any item to which the hang tab assembly 100 can be affixed. In such embodiments, hang tab assembly 100 may be affixed directly to the item.

FIG. 3 shows an exploded view of hang tab assembly 100. Hang tab assembly 100 may be composed of at least one layer of paper material (e.g., two or three layers of paper). As used herein, paper encompasses cellulose-based sheet material of various thicknesses and compositions, including, for example, letter paper, card stock, cover stock, and cardboard, of single-ply or multi-ply structure.

Hang tab assembly 100 may be one unitary layer or formed of two or more layers. In some embodiments, hang tab assembly 100 may include one layer, that is, an outer layer 200. In some embodiments, hang tab assembly 100 may include two layers, that is, outer layer 200 and an inner layer 300, each of which may be formed of a suitable paper material. In some embodiments, each layer may be formed of multi plies (e.g., multi-ply papers) of fibers (e.g., solid bleached primary fibers) pressed in one paper layer which provides desirable strength and stiffness while being able to be torn internally (e.g., in a direction parallel to the paper's surfaces) as will be described in more detail below.

In some embodiments hang tab assembly 100 may further include a support layer 400 arranged between outer layer 200 and inner layer 300 such that support layer 400 may have one side attached to outer layer 200 and the opposite side attached to inner layer 300. Support layer 400 may be formed of paper different from or the same as outer layer 200 and inner layer 300. In selecting the materials for each layer, particularly outer layer 200, the thickness may be a factor to be considered due to the normal force and the shear force applied when tearing away kiss-cut portions, as will be described later in this disclosure. These are merely examples such that any paper having comparable strength and design can be considered.

Referring to FIG. 3, when hang tab assembly 100 consists of three layers in some embodiments, outer layer 200 may include a first opening 220, inner layer 300 may include a second opening 320, and support layer 400 may include a third opening 420. As shown, first, second and third openings 220, 320, and 420 have the same shape to align with each other. These openings allow hang tab assembly 100 to be hung on, e.g., a wire rack or peg at a retail store. In various embodiments, first, second, and third openings, 220, 320, 420 may have a circular shape having a certain diameter at the center and may elongate outwardly with a smaller diameter/width than the center circular shape to fit on different shapes of wire rack or peg, such as a double peg shape or a single peg shape. The shape of the openings can be varied based on the size, weight, or material composition of package 10 as well as hang tab assembly 100.

In some embodiments, outer layer 200, inner layer 300, and support layer 400 may have surface areas different from each other. For instance, while lengths of at least portions of each of outer layer 200, inner layer 300, and support layer 400 in a longitudinal direction (e.g., x-direction in FIG. 3) may be equivalent, a length of each layer in a transverse direction (e.g., y-direction in FIG. 3), which is orthogonal to the longitudinal direction, may be different from each other. Outer layer 200 may have the longest length in the transverse direction and support layer 400 may have the shortest length in the same direction. In this way, support layer 400 having the smallest surface area can be securely sandwiched between outer layer 200 and inner layer 300.

In addition, the thickness of each layer (i.e., outer layer 200, inner layer 300, and support layer 400) may be the same or different from each other, based on the type of papers, as described above, used for each layer.

Hang tab assembly 100 may further include a double-sided adhesive 700 ("third double-sided adhesive 700") for affixing support layer 400 to outer layer 200. Double-sided adhesive or third adhesive 700 may have a shape corresponding to support layer 400 to be entirely attached thereto. Hang tab assembly 100 may further include a double-sided adhesive 800 ("fourth double-sided adhesive 800") for affixing support layer 400 to the inner layer 300. Similar to adhesive 700, double-sided adhesive or fourth adhesive 800 may have a shape corresponding to support layer 400 to be entirely attached thereto. Double-sided adhesives 700, 800 also include openings that correspond to first, second, and third openings 220, 320, and 420 to allow a package 10 to which hang tab assembly 100 is affixed to be hung as described above. In some embodiments (e.g., embodiments omitting support layer 400), outer layer 200 and inner layer 300 may be directly affixed to each other (e.g., using a double-sided adhesive such as third adhesive 700 or fourth adhesive 800). Adhesives described herein may be, for example, a pressure-sensitive adhesive, a double-sided adhesive tape, or glue. In some embodiments, the adhesives may be transparent to minimize interference with the aesthetic of package 10.

The above-described configuration can provide durability to hang tab assembly 100 when assembled and in use for hanging a package 10. In addition, hang tab assembly 100 according to some embodiments can provide a tamper-evident seal function alerting a potential buyer (or retail clerk or any other person) that the package having hang tab assembly 100 has been opened or not by leaving an overt visual indication that a seal of hang tab assembly 100 has been opened as will be described in further detail below.

In some embodiments, outer layer 200 of hang tab assembly 100 can provide the tamper-evident seal function. For example, outer layer 200 may be a unitary body composed of two panels having different shapes. Outer layer 200 of hang tab assembly 100 may include a hanging panel 240 in which first opening 220 is defined (e.g., at its center), and may include a tear-away panel 260 that extends integrally from the hanging panel 240 in the y-direction as one single integrally formed panel. As shown in FIG. 3, hanging panel 240 may have a length in the transverse direction (e.g., y-direction) greater than that of tear-away panel 260, and tear-away panel 260 may have a length in the longitudinal direction (e.g., x-direction) greater than that of hanging panel 240. The length of tear-away panel 260 in the longitudinal direction may be longer due to one or more grip portions 260A which will be described in detail later in this disclosure.

In some embodiments, support layer 400 and third and fourth adhesives 700 and 800 may have the same surface area. Outer layer 200, particularly hanging panel 240, may have a surface area greater than those of support layer 400 and third and fourth adhesives 700 and 800, but smaller than that of inner layer 300. Put another way, hanging panel 240 may have a greater length in the transverse direction than that of support layer 400 and a lesser length in the transverse direction than that of inner layer 300.

Figure 4A:
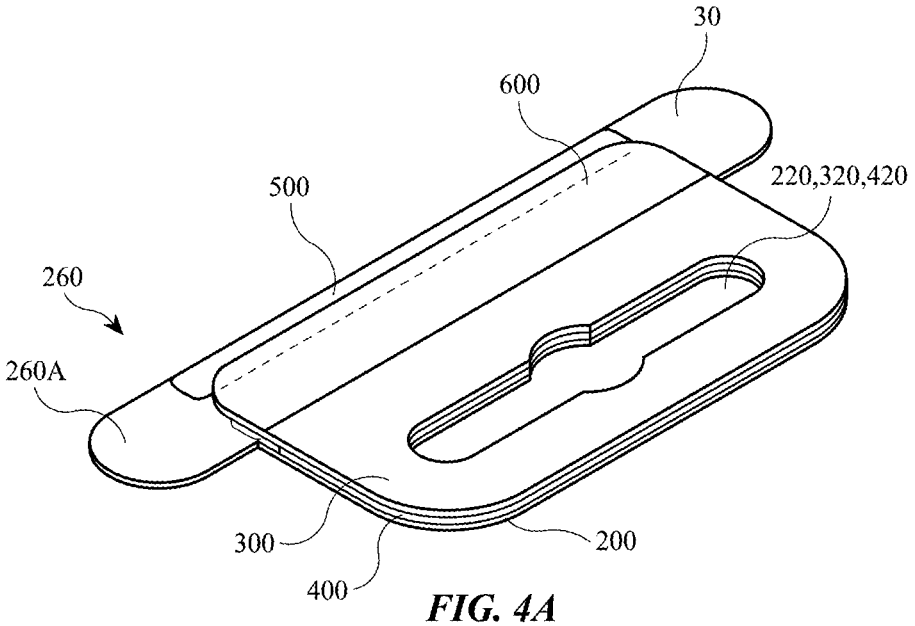
FIGS. 4A and 4B illustrate the hang tab assembly according to some embodiments as assembled without protective liners.
Figure 4B:
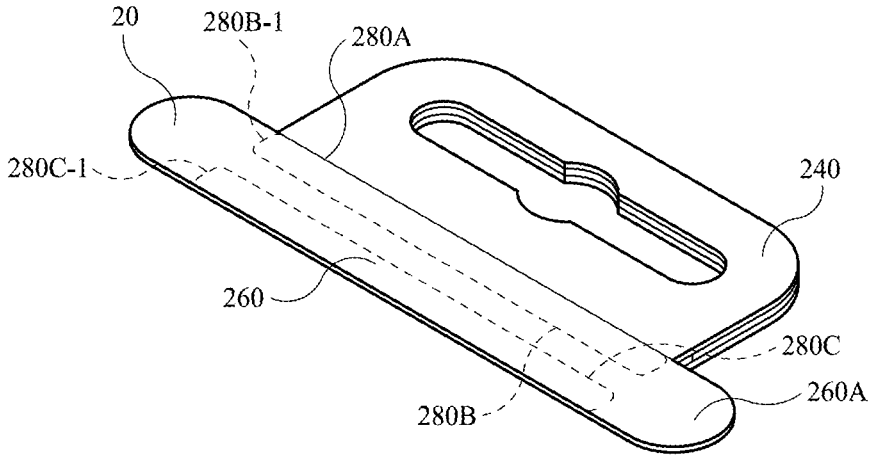

FIGS. 4A, 4B, 5A, and 5B illustrate layers of hang tab assembly 100 in various states of assembly. For instance, FIG. 4A is a view from a lower surface 30 (e.g., the lower surface being adhered to package 10) of hang tab assembly 100 showing inner layer 300, and FIG. 4B is a view from an upper surface (e.g., the upper surface not being adhered to package 10) of hang tab assembly 100 showing outer layer 200.

FIG. 4A further shows double-sided adhesives 500 and 600 ("first and second adhesives 500, 600) attached to a portion of tear-away panel 260 and a portion of inner layer 300, respectively. More specifically, first adhesive 500 is attached to an edge portion of tear-away panel 260 spaced away from hanging panel 240, and second adhesive 600 is attached to an edge portion of inner layer 300 spaced away from second opening 320.

Figure 5A:
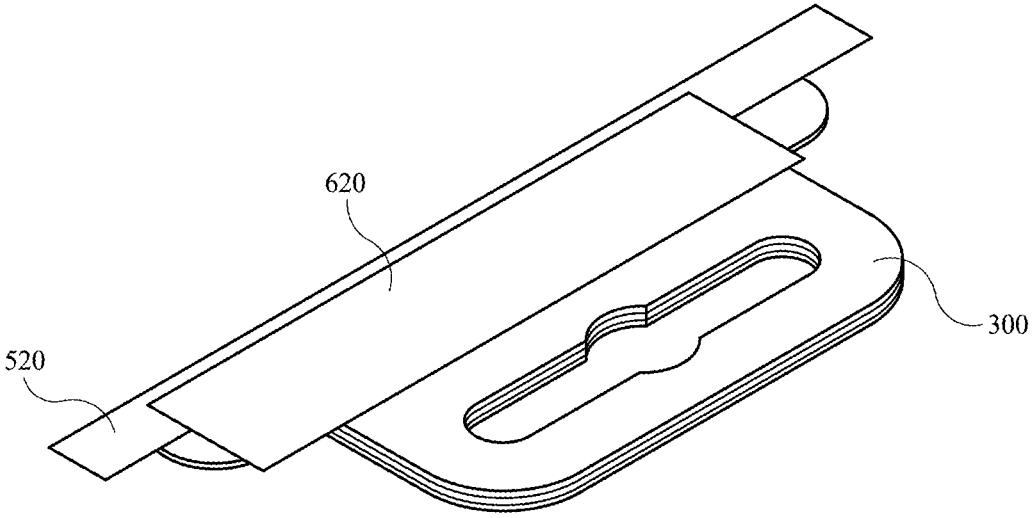
FIGS. 5A and 5B illustrate the hang tab assembly according to embodiments of the present disclosure as assembled with protective liners.
Figure 5B:
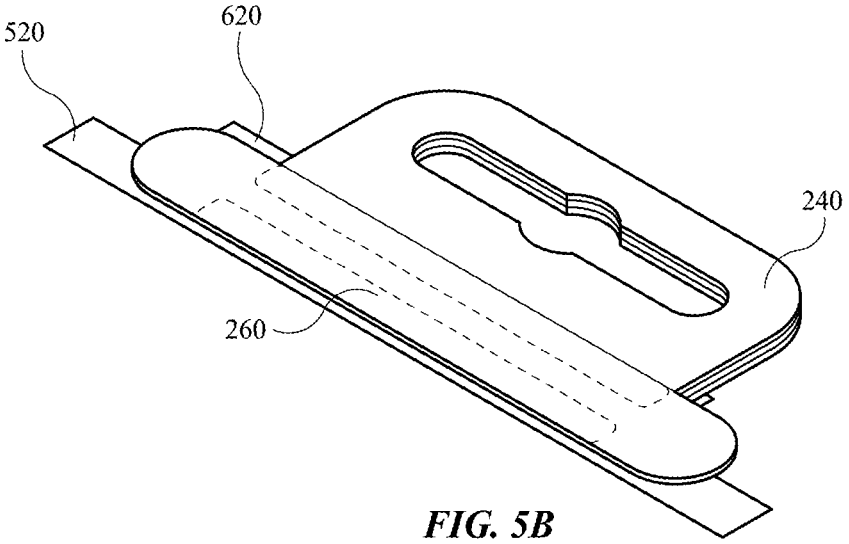

In addition, first and second adhesives 500, 600 may be prepared on first and second removable protective liners 520 and 620, respectively, as shown in FIG. 3, to be detachably attached to tear-away panel 260 and inner layer 300. FIGS. 5A and 5B illustrate respective views of FIGS. 4A and 4B with first and second removable protective liners 520 and 620 thereon. In some embodiments, hang tab assembly 100 can be provided with first and second removable protective liners 520 and 620 before affixing to a package or an item for sale. In some embodiments, first and second adhesives 500, 600 can be covered by respective removable protective liners 520 and 620, to protect the adhesive from adhering to anything before intended.

Release liners described herein may be formed of, for example, plastic or paper, and may be thinner and more flexible than hang tab assembly 100, more specifically, outer layer 200, inner layer 300, and support layer 400. A user can easily remove removable protective liner 620 to expose second adhesive 600 and then remove removable protective liner 520 to expose first adhesive 500 in order when affixing hang tab assembly 100 to a package, which will be described later.

In some embodiments, hang tab assembly 100 has functions of securely hanging a package and providing a tamper-evident seal as mentioned above. The hanging function can be achieved by the openings of each layer of hang tab assembly 100, the overall thickness and the weight of hang tab assembly 100, and the way in which hang tab assembly 100 is affixed to a package. The tamper-evident seal function may be achieved by outer layer 200 having a plurality of "kiss-cuts" formed thereon in combination with the manner and structure by which hang tab assembly 100 is affixed to the package.

Figure 6A:
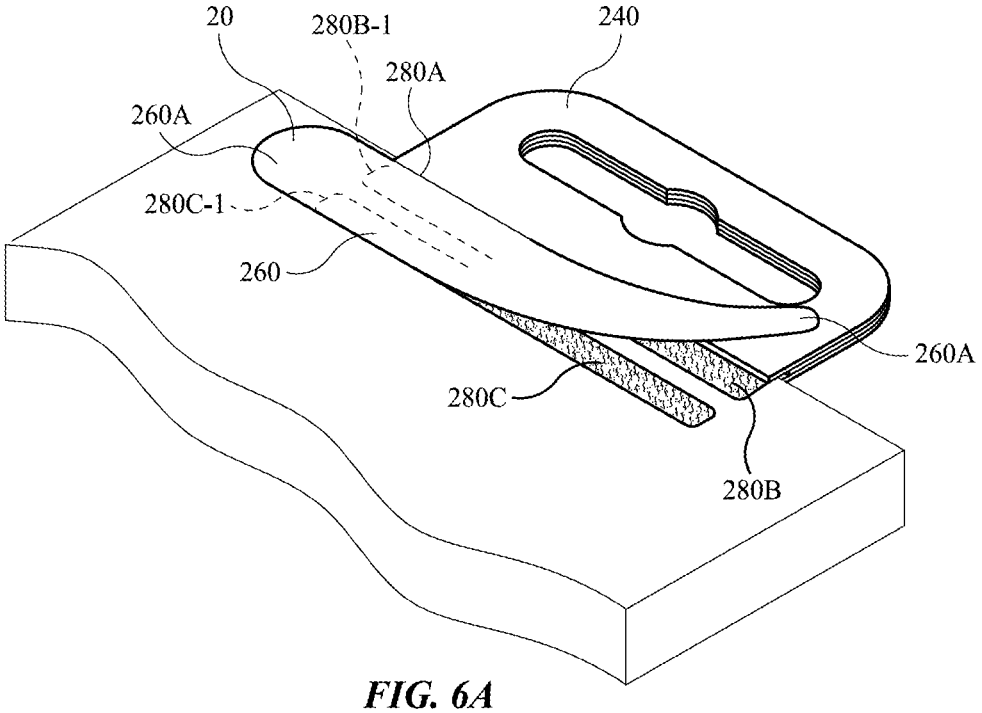
FIGS. 6A and 6B illustrate a manner of unsealing by tearing along kiss-cuts of the hang tab assembly, according to some embodiments of the present disclosure.
Figure 6B:
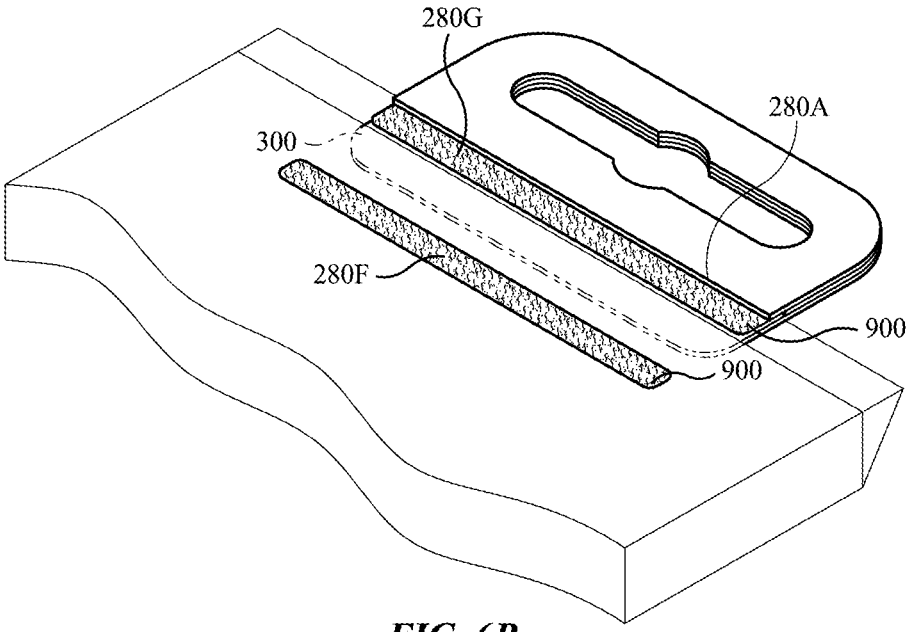

For example, referring to FIGS. 2, 6A and 6B, hanging panel 240 and tear-away panel 260 of outer layer 200 may be formed of a unitary paper body or panel and may be defined or partially separated by a shallow cut line or a kiss-cut path 280A extending in the longitudinal direction on outer layer 100 at an upper surface 20. The "kiss-cut" path is a cut made partially or halfway through outer layer 200 (e.g., in the z-direction, see FIG. 3) allowing a portion of tear-away panel 260 to be torn away, while another portion of tear-away panel 260 remains affixed to a package 10, when a user is removing tear-away panel 260 to open package 10.

As shown in the drawings, the "kiss-cuts" described herein may be formed on outer layer 200 to provide a user-friendly mechanism for opening the package while also providing a tamper-evident seal that maintains sufficient structure for hanging. The term "kiss-cut" or kiss cutting is a form of cut (e.g., formed by die cutting or scoring) where the cut cuts partially through the material, but not entirely through the material such that the depth of cut is less than the thickness of the material and terminates inside the substance of the material (e.g. a cut having a depth roughly half of the thickness of the material). In this way, a kiss-cut can allow the paper material of, e.g., outer layer 200, to retain a high degree of strength in a direction parallel to its paper surfaces through the portion that is not cut through by the kiss cut, while allowing the paper material to more easily separate in a controlled manner when a force is applied in a perpendicular (normal) direction.

As mentioned, in some embodiments outer layer 200, formed of paper, includes kiss cuts to effect its functions of sealing, supporting, opening, and providing tamper-evidence relative to a package to which it is affixed. For example, FIGS. 7A-7C show a schematic section view of a portion of outer layer 200.

Figure 7A:
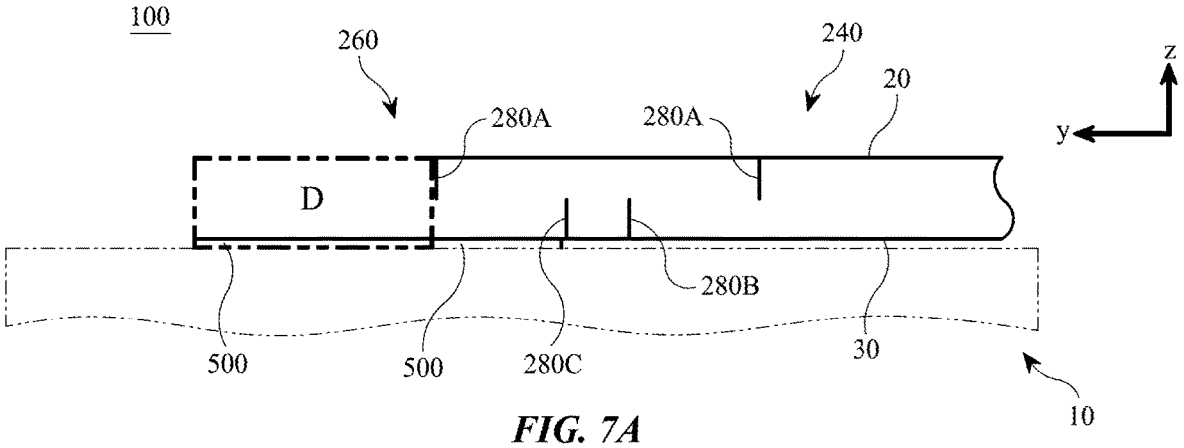
FIGS. 7A-7C illustrate a schematic sectional view showing an example of a paper having kiss-cut opening structures and an opening operation tearing at the kiss-cuts.
Figure 7B:
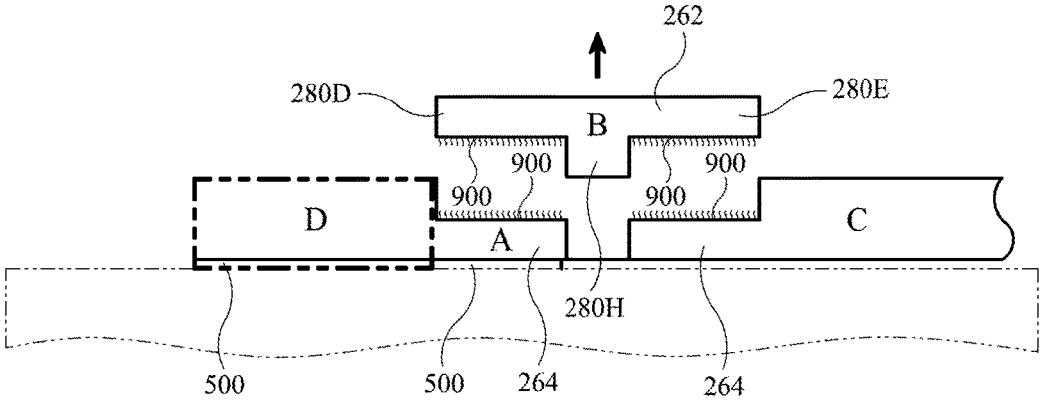
Figure 7C:
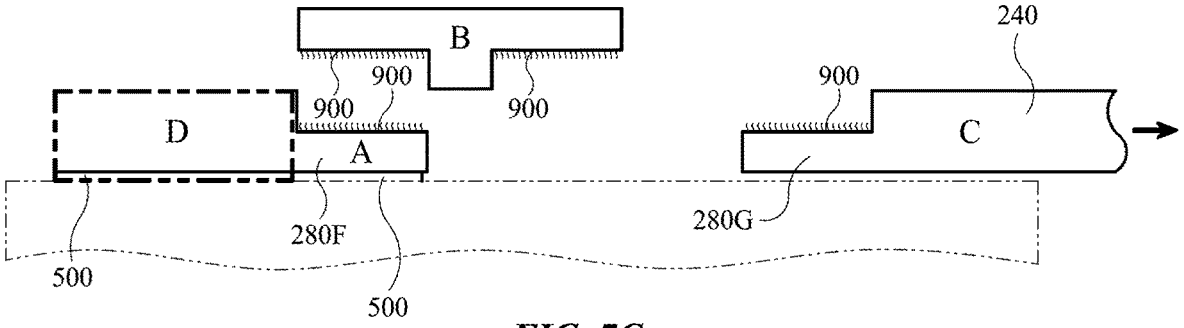

Assuming that outer layer 200 shown in FIGS. 7A-7C is affixed to a package (e.g., package 10) as assembled, outer layer 200 may be formed with three or more kiss-cuts. That is, outer layer 200 may have one first kiss-cut path 280A on an upper surface 20 and two kiss-cut paths 280B, 280C on lower surface 30 that is opposite to upper surface 20 in the z-direction (see FIGS. 2, 3, 4A, 4B, 6A, and 7A; in FIGS. 3 and 4B, and throughout the drawings, kiss-cut paths 280B, 280C are represented by broken phantom lines because they are on the far side of the panel in those views, though kiss-cut paths 280B, 280C are continuous, like kiss-cut path 280A).

In some embodiments, outer layer 200 may include two first kiss-cut paths 280A on upper surface 20 and two kiss-cut paths 280B, 280C ("second and third kiss-cut paths 280B, 280C") on lower surface 30. For instance, portion "D" in FIGS. 7A-7C in some embodiments may be an additional or optional portion such that portion D can be omitted, or separated by a kiss-cut on upper surface 20. In other words, the number of "kiss-cuts" can be varied as necessary, but not limited to three kiss-cuts but can be two kiss-cuts, four kiss-cuts or more.

Outer layer 200 may further include first adhesive 500 on a portion of lower surface 30 thereof. As tear-away panel 260 is pulled, this applies a force to outer layer 200 at the kiss-cuts by an upward (e.g., in the z-direction, see FIGS. 3 and 7B) pulling force. This causes outer layer 200 and tear-away panel 260 to be separated or divided into three sections (A, B, and C; or A and D as combined, B, and C) as shown in FIGS. 7B and 7C. Tear-away panel 260 is likewise separated into three portions: tear-away portion 262, and tamper evident portions 264 (280F and 280G).

The tears are formed within the paper material of outer layer 200, extending in a direction parallel to the surfaces of outer layer 200 between interior ends of adjacent kiss-cut paths that are on opposing sides of outer layer 200 (e.g., between kiss cut paths 280A and 280B) or between a kiss cut path and an outer edge of tear-away panel 260, thereby exposing an interior of the paper forming outer layer 200 between kiss-cut paths. The exposed interior provides visibly unfinished, rough, or fuzzy exposed surfaces 900 at peripheral portions 280D and 280E of tear-away portion 262 and at tamper-evident portions 280F and 280G. Because tamper-evident portions 280F and 280G remain affixed to package 10, the exposed interior of the paper at these portions provides a visible indication that the package has been unsealed.

Each of peripheral portions 280D, 280E and tamper-evident portions 280F, 280G have a partial (e.g., half) thickness of outer layer 200 before pulled away, while a center portion 280H is entirely torn away with peripheral portions 280D and 280E maintaining the full thickness of outer layer 200.

Here, the thicknesses after being pulled away at the kiss-cuts may depend on the depth of each kiss-cut. Such that if the first kiss-cut path or paths (e.g., 280A) are cut more than halfway through the paper, peripheral portions (e.g., 280D, 280E) may have thickness corresponding to the depth of the first kiss-cut path or paths. Similarly, if second and third kiss-cut paths (e.g., 280B, 280C) are cut into more than halfway through the paper, tamper-evident portions (e.g., 280F, 280G) may have thickness corresponding to the depth of the second and third kiss-cut paths.

After the tearing away is completed, portion "A" (or portions "A" and "D") which have adhesive 500 on lower surface 30 remain affixed to package 10 while portion "B" can be separated from the package, thus unsealing the package while providing clear indication that the package has been opened. More specifically, portion "A" (or portions "A" and "D") can be affixed to a side surface of package 10 and portion "C" can be partially affixed (e.g., indirectly through other structure of hang tab assembly) to an opening top (e.g., tuck flap) of package 10, while portion "B" can be entirely separated from package 10. Exposed surfaces 900 at the separation portions may have irregular shapes and sizes, which can vary based on the material composition. As shown, outer layer 200 is separated into three portions creating a space between "A" and C", corresponding to the length of center portion 280H in the y-direction, due to center portion 280H defined by second and third kiss-cut paths 280B, 280C.

In addition, distances between each kiss-cut path, particularly between adjacent kiss-cut paths on opposing sides of their respective panel that are intended to create tears (e.g., first kiss-cut path 280A and second kiss-cut path 280B), is a factor for allowing the subtle and ideal internal separation (e.g., lateral tearing) of outer layer 200 as shown in the drawings for providing a tamper-evident effect while allowing easy opening of the seal. The kiss cuts operate in pairs, each kiss-cut offset from a kiss cut (or a through cut/edge) on the other side of outer layer 200. As described above, the kiss-cuts terminate within the material of outer layer 200, such that their terminal ends are buried within the material. As a normal force is applied to material at one side of the paired kiss cuts, the material of outer layer 200 will fail creating a tear between the buried ends of the kiss cuts (see, e.g., FIGS. 2, 6A, and 7B), thereby effecting the separation of portions of outer layer 200 to allow its associated packaging 10 to be opened, and providing lateral tear surfaces 900 that provide visual evidence of tampering and that cannot be repaired.

As will be described below, the distance between each kiss-cut path may be between 1 mm to 6 mm, particularly, the distance between first kiss-cut path 280A and second kiss-cut path 280B may be between in a range of, e.g., 2 mm-6 mm, while the distance between second kiss-cut path 280B and third kiss-cut path 280C may be in a range of, e.g., 1 mm-4 mm (e.g., 1 mm-2 mm.

Referring to FIGS. 2, 6A and 6B, in some embodiments, outer layer 200 may have kiss-cutting applied thereon to form first kiss-cut path 280A on upper surface 20 of outer layer 200 between hanging panel 240 and tear-away panel 260. Tear-away panel 260 can further include one or more second kiss-cut paths 280B, 280C on lower surface 30 that is opposite to first kiss-cut path 280A. First and second kiss-cut paths 280A and 280B may extend parallel to each other on the opposite sides of hang tab assembly 100. In some embodiments, second and third kiss-cut paths 280B, 280C can form full-thickness center portion 280H bounded by two kiss-cut paths 280B, 280C. As will be described in more detail, center portion 280H is not directly affixed to a package 10 to which hang tab assembly 100 is attached, but can be completely removed to separate outer layer 200 into two portions not only vertically but also laterally.

In some embodiments, second and third kiss-cut paths 280B, 280C may be offset from first kiss-cut path 280A in the y-direction to allow the tearing of outer layer 200 into two portions. As described above, the distance between first kiss-cut path 280A and second kiss-cut path 280B in the y-direction may be between, e.g., 2 mm and 6 mm, or more preferably 4 mm, to allow the normal force and shearing force to tear outer layer 200 into two layers by a user's manipulation. Similarly, the distance between second kiss-cut path 280B and third kiss-cut path 280C in the y-direction may be between, e.g., 1 mm and 4 mm, or more preferably 2.5 mm.

In addition, hang tab assembly 100 may include one or more grip portions 260A at an end of tear-away panel 260 in the longitudinal direction for a user to grip and pull away tear-away panel 260. Due to first, second, and third kiss-cut paths 280A, 280B, 280C, portions of tear-away panel 260 can be laterally torn into two layers by a pulling force as shown in FIG. 2 (see also FIG. 7B) exposing internal exposed surfaces 900 thereon. Hang tab assembly 100 in some embodiments may have only one grip portion 260A at one end or may have two grip portions 260A to tear from either direction per user's preference (e.g., left to right or right to left). When one or more grip portions 260A are provided, second and third kiss-cut paths 280B, 280C can respectively curve outwards and extend to first kiss-cut path 280A and outer edge of tear-away panel 260, respectively, forming a first grip portion kiss-cut path 280B-1 and a second grip portion kiss-cut path 280C-1 at each grip portion 260A.

For instance, with reference to FIGS. 2 and 7B, when a user grip one of the grip portions 260A and pulls in one direction, a tear-away portion 262 of tear-away panel 260 may be torn away and separated from hanging panel 240 between first kiss-cut path 280A and second kiss-cut path 280B. Simultaneously, tear-away panel 260 can be further separated between third kiss-cut path 280C and an edge of tear-away panel 260. That is, as tear-away panel 260 is torn away by pulling grip portion 260A, tear-away panel 260 is torn apart exposing inside layers while a full-thickness portion 280H of tear-away portion 262 can be entirely torn away due to second and third kiss-cut paths 280B, 280C and first adhesive 500 fixing a non-tom away portion of tear-away panel 260 (e.g., tamper-evident portion 280F) to package 10. In some embodiments, when the grip portion 260A is pulled, first and second grip portion kiss-cut paths 280B-1, 280C-1 allow the grip portion 260A to more easily separate and initiate the tearing of the tear-away panel 260.

As shown, tear-away panel 260 is firstly separated into two partial layers in the z-direction by exposing peripheral portions 280D and 280E having exposed surfaces 900 as partial thickness tom away portions of tear-away panel 260 and tamper-evident portions 280F and 280G as partial-thickness non-torn away portions of tear-away panel 260, respectively facing torn-away peripheral portions 280D and 280E. Center portion 280H, together with peripheral portions 280D and 280E may form a T-shape cross section (see FIGS. 7B, 7C).

In some embodiments, a lower surface of remaining-on tamper-evident portion 280F (e.g., lower surface 30 of tear-away panel 260) can be securely attached to package or item 10 to which hang tab assembly 100 is affixed by first adhesive 500. On the other hand, remaining-on tamper-evident portion 280G is not directly attached or adhered to the same panel of package 10 (though may be indirectly adhered to another portion of package 10 that is movable with respect to the portion to which tamper-evident portion 280G is adhered, as explained elsewhere herein), thus allowing opening of package 10 when the torn-away layer of the tear-away panel 260 is completely removed.

As described above, the kiss-cut paths formed on tear-away panel 260 can create separation within tear-away panel 260, thus providing clear visual evidence that an adhered package 10 has been opened or otherwise tampered with when tear-away panel 260 is disturbed via unsealing (e.g., surfaces on remaining-on portions 280F and 280G being exposed as shown FIG. 2) when it is torn open by removing teat-away portion 262. A person can easily recognize whether a package has been opened or there has been an attempt to open the package, and it will be impossible to seal back to the original condition.

Figure 8:
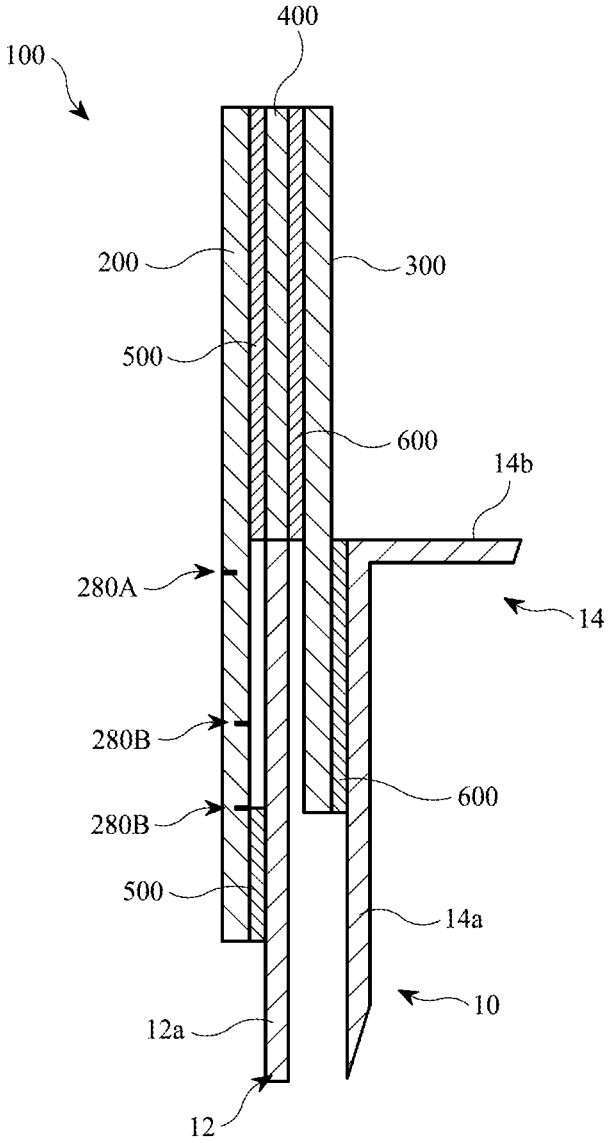
FIG. 8 illustrates a sectional schematic view of the hang tab assembly having kiss-cuts formed thereon coupled to a package, according to some embodiments.

FIG. 8 illustrates hang tab assembly 100 affixed to package 10 in a use configuration, according to some embodiments. FIG. 8 is schematic illustrations, and thicknesses and sizes shown are exaggerated for clarify, of description. In this use configuration, first adhesive 500 of outer layer 200 may be affixed to an exterior surface 12*a* of a package side wall 12 of package 10, and inner layer 300 may be affixed to tuck flap 14*a* of a package top 14 of package 10. When so affixed, relative movement of outer layer 200 and inner layer 300 may be limited, and may in turn limit relative movement of package top 14 and package side wall 12, thereby preventing opening of package top 14 to safely keep package 10 in a sealed configuration.

When in the use configuration sealing package 10, openings (e.g., the first, second and third openings 220, 320, and 420 and openings of first and second adhesives 500 and 600) of hang tab assembly 100 may be positioned over a display hook or other support to hang tab assembly 100 (and package 10) therefrom. In this way, package 10 can be displayed (e.g., for purchase in a retail environment) while remaining sealed to protect its contents from tampering. Further, since tuck flap 14*a* may be inserted within package side wall 12 in the use configuration, it can be hidden from view. In other words, hang tab assembly 100 in some embodiments may not be attached to a top surface of package 10 (e.g., an upper surface 14*b*), thereby minimizing the visual effect of hang tab assembly 100 on package 10. In other embodiments, hang tab assembly 100 may be further affixed to top surface of package 10 to provide further stability and improved adherence.

In some embodiments, support layer 400 is entirely adhered between outer layer 200 and inner layer 300 by adhesives (e.g., third and fourth adhesives 700, 800). Support layer 400 may have a thickness that is substantially equal to that of side wall 12 (e.g., as shown in FIG. 8). This spacing formed between outer layer 200 and inner layer 300 can improve the sturdiness and durability of hang tab assembly 100 when affixed to package 10 in a vertical position by adhering only portions of outer layer 200 and inner layer 300 to package 10 (e.g., portions at first and second adhesives 500, 600) without straining on other layers (e.g., outer layer 200, inner layer 300) to accommodate the thickness of wall 12.

Figure 9:
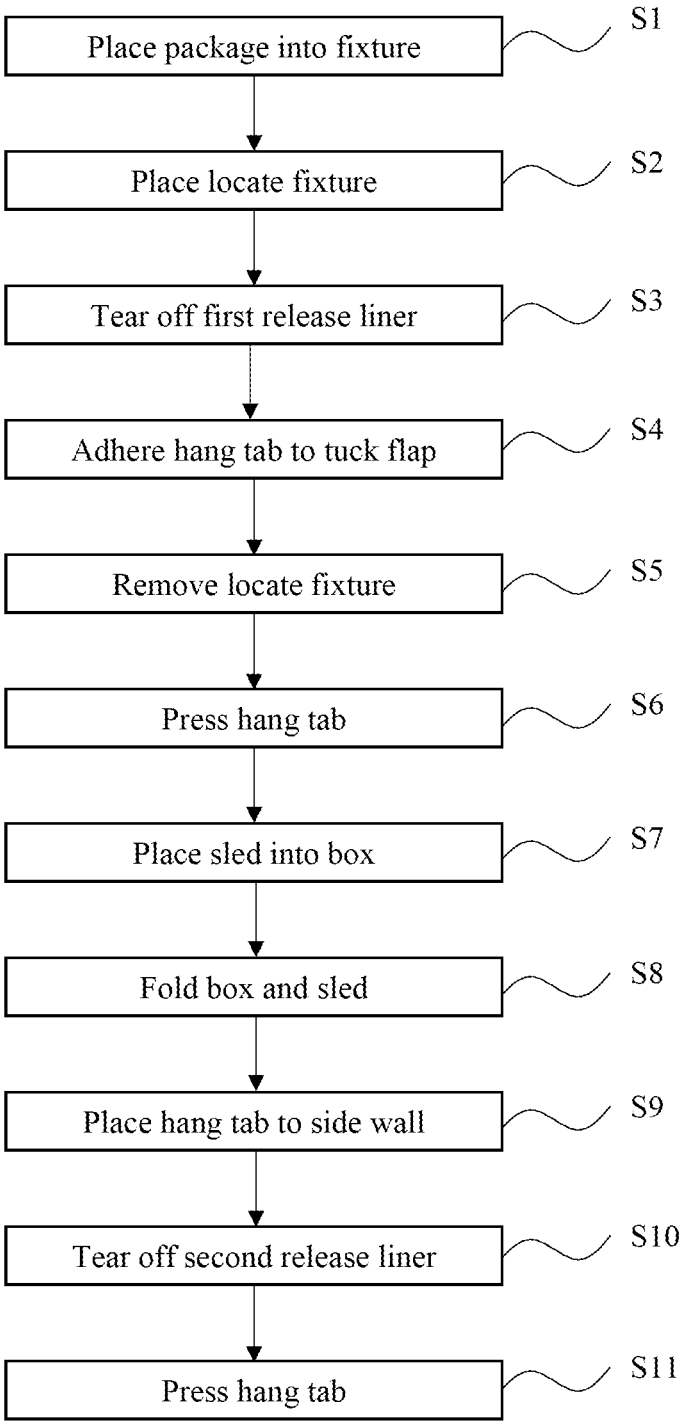
FIG. 9 is a flow chart illustrating a process of affixing the hang tab assembly to a package, according to some embodiments.
Figure 10A:
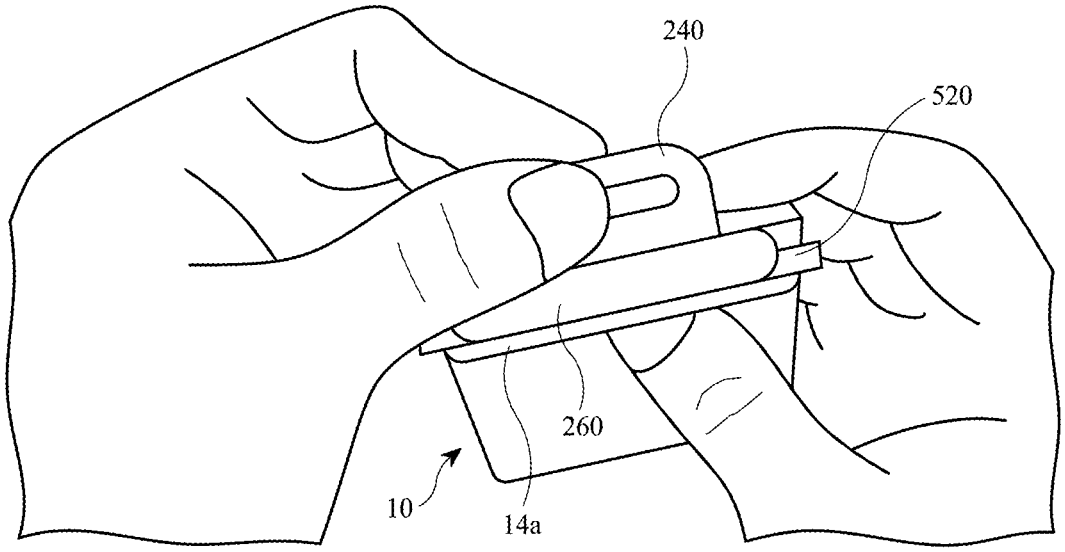
FIGS. 10A and 10B illustrate affixing the hang tab assembly to a package for use, by adhering to a tuck flap and then adhering to a side wall of the package, according to some embodiments.
Figure 10B:
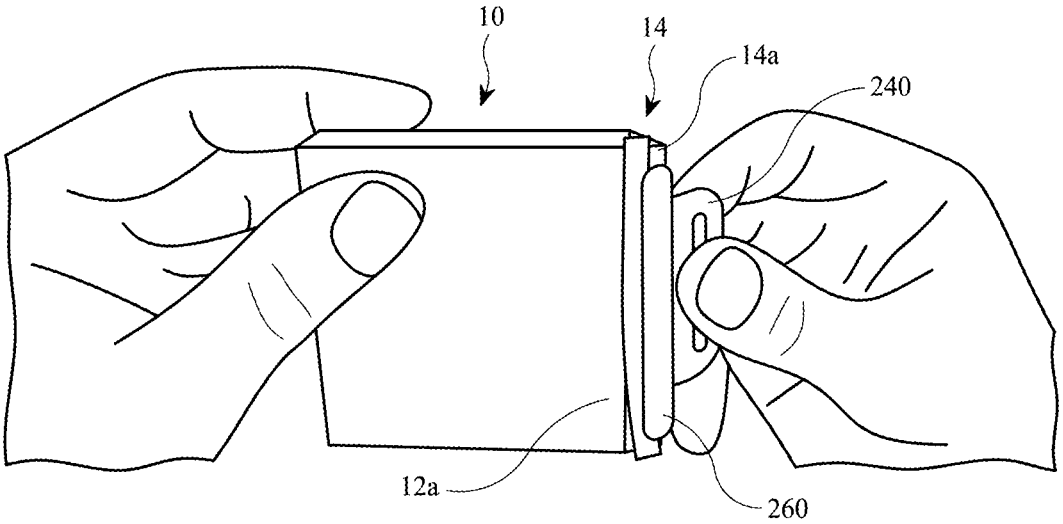

FIG. 9 is a flow chart showing an application of hang tab assembly 100, and FIGS. 10A and 10B illustrate affixing hang tab assembly 100 to a package 10 for use, by adhering to tuck flap 14*a* and then adhering to side wall 12 of package 10. To use hang tab assembly 100, person may, for example, place package 10 into fixture to hold package 10 securely in place at step S1. However, the use of fixture in this step may be an option per the user's preference or availability. Then, the person or user can place a locate fixture at step S2, wherein the locate fixture has a shape that corresponds to outer layer 200. Similar to step S1, step S2 of using the locate fixture can be optional.

Once the location of hang tab assembly 100 is determined, the user can tear or peel off second removable protective liner 620 to expose second adhesive 800 at step S3. The person may align and affix hang tab assembly 100 to tuck flap 14*a* of package top 14 using second adhesive 600 at step S4 (see FIG. 10A), and remove locate fixture at step S5 if locate fixture is used. That is, inner layer 300 is firstly attached to tuck flap 14*a* of package 10. Then, the person can apply a certain pressure or more by using, e.g., a silicone gel roller or the like, to secure the affixation of hang tab assembly 100 to package 10 at step S6.

Once hang tab assembly 100, more specifically, inner layer 300, is affixed to package 10, the fixture used in step S1 can be removed and a sled, which can keep package 10 in shape, can be placed into package 10 as optional at step S7, and package 10 can be closed by tucking in tuck flap 14*a* inside (e.g., inner side of tuck flap 14*a*) package 10 while leaving outer layer 200 out at step S8. At step S7, an item to be packaged can be inserted in package 10 with the sled before closing package 10 (such item could be inserted at any other time before package 10 is sealed). Then, package 10 can be optionally placed back into the fixture used in step S1 at step S9. The person can tear off first removable protective liner 520 to expose third adhesive 700 attached on tear-away panel 260 of outer layer 200 as shown in step S10 (see FIG. 10B), and finally press down such that a portion (a portion between an outer edge and third kiss-cut path 280C) of tear-away panel 260 as described above to package side wall 12 of package 10 to securely seal package 10. The hang tab according to various embodiments is now securely attached to the package and ready for use.

In addition, FIG. 1 illustrates grip portion 260A being directed to tear from the left to right (i.e., in the x-direction of FIG. 3); however, this is not limited thereto such that the indicia (e.g., arrow mark 40) can be on the other grip portion or on both grip portions 260A. In some embodiments, hang tab assembly 100 may have only one grip portion 260A as noted above, or two grip portions 260A at both sides with one arrow mark 40 on one of two grip portions 260A or arrow mark 40 on each grip portion 260A. Hang tab assembly 100 may be affixed to a package that can fit on different shapes of wire rack, such as a double peg shape and a single peg shape.

To un-seal package 10, a person may grasp any one of grip portions 260A as a part of tear-away panel 260 and pull from the left to right or right to left with sufficient force to cause tear-away panel 260 to break into two layers to tear away at kiss-cut paths, as described above and shown, e.g., in FIG. 2, while keeping a portion of tear-away panel 260 attached on package 10 (e.g., remaining-on tamper-evident portion 280F). Then, a person may pull upward on hanging panel 240 to open package 10 leaving exposed surfaces 900 on remaining-on tamper-evident portions 280F and 280G as well as torn-away peripheral portions 280D, 280E as evidence of the unsealing of tear-away panel 260.

In some embodiments, any surface finishing may take place after the components are cut from the blank, or alternatively prior to the blank being cut into separate sheets for assembling to a final product. Additionally, some operations may be performed concurrently. All or some of the surfaces of the packaging may be coated, or laminated, which may increase structural strength properties such as rigidity, which may protect a product within the packaging, or avoid scratching, and which may further improve the surface properties toward preferred haptics or optics.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A hang tab assembly for sealing and hanging a package, the assembly comprising:

a paper outer layer comprising:

a hanging panel including a first opening;

a tear-away panel adjacent to the hanging panel;

a first kiss-cut path extending in a longitudinal direction along a boundary between the hanging panel and the tear-away panel on an upper surface of the outer layer; and a second kiss-cut path extending in the longitudinal direction on a lower surface of the tear-away panel, wherein the second kiss-cut path is offset from the first kiss-cut path in a transverse direction orthogonal to the longitudinal direction;

a paper inner layer having a second opening corresponding to the first opening, the inner layer coupled to the outer layer;

a first adhesive disposed on the lower surface of the tear-away panel entirely to one side of the second-kiss-cut path; and a second adhesive disposed on a lower surface of the inner layer facing away from the upper surface of the outer layer.

2. A hang-tab package-sealing system, the system comprising:

the hang tab sealing assembly of claim 1;

a package movable between an open and a closed configuration, the package comprising a tuck flap and a side wall, wherein the tuck flap and the side wall are parallel to each other when the package is in the closed configuration, wherein the inner layer is affixed to the tuck flap and disposed between the tuck flap and the package side wall when the package is in the closed configuration, and wherein the package is sealed in the closed configuration by the first adhesive adhering a portion of the tear-away panel to an outer surface of the package side wall and the second adhesive adhering a portion of the inner layer to the tuck flap.

3. The system of claim 2, wherein the tear-away panel is configured to be partially torn away to unseal the package, wherein when the tear-away panel is torn away, the tear-away panel is configured to separate into:

a tear-away portion that separates from the package side wall, the tear-away portion comprising:

a full-thickness portion disposed between the second kiss-cut path and a third kiss-cut path spaced apart from the second kiss-cut path and extending in the longitudinal direction on the lower surface of the tear-away panel; and a first partial-thickness portion disposed between the first kiss-cut path and the second kiss-cut path; and a tamper-evident portion that remains adhered to the package side wall, the tamper-evident portion comprising a second partial-thickness portion disposed between the first kiss-cut path and the second kiss-cut path.

4. The system of claim 3, wherein when the tear-away panel is torn away:

the tear-away portion separates from the tamper-evident portion by creating a tear between the first kiss-cut path and the second kiss cut path, which exposes an interior of the paper forming the outer layer between the first kiss-cut path and the second kiss-cut path; and the hang tab sealing assembly separates into an upper portion and a lower portion, unsealing the package.

5. The system of claim 4, wherein the exposed interior of the paper provides a visible indication that the package has been unsealed.

6. The system of claim 2, wherein hang tab sealing assembly further comprises:

a support layer entirely adhered between the outer layer and the inner layer, wherein the support layer has a third opening corresponding to the first and second openings, wherein the support layer has a thickness at least equal to that of package side wall.

7. The assembly of claim 1, further comprising a third kiss-cut path extending on the lower surface of the tear-away panel parallel to the second kiss-cut path, wherein the third kiss-cut path is offset from the second kiss-cut path in the transverse direction away from the first kiss-cut path, and the first adhesive is entirely disposed between the third kiss-cut path and an edge of the tear-away panel.

8. The assembly of claim 1, wherein the first and second kiss-cut paths are offset in the transverse direction by a distance within a range from 2 mm to 6 mm.

9. The assembly of claim 1, wherein the tear-away panel comprises:

a tear-away portion comprising a center portion extending at a center of the tear-away panel in the longitudinal direction bounded by the second kiss-cut path and a third kiss-cut path on the lower surface of the tear-away panel, wherein the center portion is configured to be entirely torn away when a user tears the tear-away portion away; and a tamper-evident portion extending in the longitudinal direction adjacent to the tear-away portion at each outer side of the center portion, wherein the tamper-evident portion is configured to separate from the remainder of the tear-away panel when the user tears the tearaway portion away, the separation occurring in the transverse direction between the first and second kiss-cut paths, and between the third kiss-cut path and an edge of the tear-away panel.

10. The assembly of claim 9, wherein the tear-away portion further comprises peripheral portions disposed adjacent to the center portion, the peripheral portions configured to separate from the tamper-evident portions when the tear-away portion is torn away.

11. The assembly of claim 9, wherein the tear-away panel comprises at least one grip portion integrally disposed at an end in the longitudinal direction, wherein the at least one grip portion is configured to be torn away with the tear-away portion in an integrated manner, and wherein the tear-away panel having the at least one grip portion has a length in the longitudinal direction greater than that of the hanging panel.

12. The assembly of claim 1, further comprising:

a paper support layer adhered between the outer layer and the inner layer, wherein the support layer has a third opening corresponding to the first and second openings.

13. The assembly of claim 1, further comprising:

a first removable protective liner detachably arranged to cover the first adhesive; and a second removable protective liner detachably arranged to cover the second adhesive.

14. The assembly of claim 1, wherein the hanging and tear-away panels of the outer layer are integrally formed of a single layer of paper.

15. The assembly of claim 14, wherein the single layer of paper is a multi-ply paper.

16. An apparatus for sealing a package, the apparatus comprising:

a first panel formed of paper;

a second panel formed of paper and extending from the first panel in a first direction in an integrated manner, wherein the second panel comprises at least one grip portion extending outward in a second direction perpendicular to the first direction;

a primary kiss-cut path extending along a boundary between the first panel and the second panel at a first surface of the second panel and the first panel; and a pair of secondary kiss-cut paths extending on the second panel parallel to the primary kiss-cut path on a second surface of the second panel opposite the first surface, wherein the pair of secondary kiss-cut paths is offset from the primary kiss-cut path in the first direction.

17. The apparatus of claim 16, further comprising:

a first adhesive disposed on the second surface of the second panel, wherein the pair of secondary kiss-cut paths comprises a first secondary kiss-cut path and a second secondary kiss-cut path that is spaced apart from the first secondary kiss-cut path toward an outer edge of the second panel, and wherein the first adhesive is arranged entirely between the second secondary kiss-cut path and the outer edge of the second panel.

18. The apparatus of claim 16, wherein the second surface of the second panel comprises:

a first portion between the primary kiss-cut path and the pair of secondary kiss-cut paths;

a second portion between the kiss-cut paths of the pair of secondary kiss-cut paths; and a third portion arranged between pair of secondary kiss-cut paths and an outer edge of the second panel, wherein a first adhesive is disposed on the third portion, and no adhesive is disposed on the first and second portions of the second panel.

19. The apparatus of claim 18, further comprising:

a third panel formed of paper and attached to the first panel; and a second adhesive disposed on a surface of the third panel overlapping and facing the same direction as the second surface of the first panel.

20. The apparatus of claim 16, wherein the primary kiss-cut path extends entirely across the first panel, and wherein the secondary kiss-cut paths do not extend entirely across the second panel.

* * * * *